US010766249B2

(12) United States Patent
Luecke et al.

(10) Patent No.: US 10,766,249 B2
(45) Date of Patent: Sep. 8, 2020

(54) METHOD AND CONTROLLER TO PREVENT INK LEAKAGE FROM A PRINT HEAD

(71) Applicant: Océ Holding B.V., Venlo (NL)

(72) Inventors: Kay Luecke, Fuerstenfeldbruck (DE); Admir Lela, Haar (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 16/103,504

(22) Filed: Aug. 14, 2018

(65) Prior Publication Data

US 2019/0047282 A1 Feb. 14, 2019

(30) Foreign Application Priority Data

Aug. 14, 2017 (DE) ..... 10 2017 118 443

(51) Int. Cl.

| | |
|---|---|
| ***B41J 2/045*** | (2006.01) |
| ***B41J 2/165*** | (2006.01) |
| ***B41J 29/17*** | (2006.01) |
| ***B41J 2/17*** | (2006.01) |

(52) U.S. Cl.

CPC ..... *B41J 2/04508* (2013.01); *B41J 2/04586* (2013.01); *B41J 2/16517* (2013.01); *B41J 2/16538* (2013.01); *B41J 2/16588* (2013.01); *B41J 2/17* (2013.01); *B41J 2/1714* (2013.01); *B41J 29/17* (2013.01); *B41J 2002/1657* (2013.01); *B41J 2002/16573* (2013.01)

(58) Field of Classification Search

CPC ..... B41J 2/04508; B41J 2/1714; B41J 2/17; B41J 2/16538; B41J 2/16517; B41J 2/16588; B41J 29/17; B41J 2/04586; B41J 2002/1657; B41J 2002/16573

See application file for complete search history.

(56) References Cited

U.S. PATENT DOCUMENTS

| | | | | |
|---|---|---|---|---|
| 2007/0229559 | A1* | 10/2007 | Oku | B41J 2/0458 347/9 |
| 2007/0263244 | A1 | 11/2007 | Sugitani et al. | |
| 2009/0091779 | A1* | 4/2009 | Ishinaga | B41J 3/543 358/1.15 |
| 2010/0026753 | A1* | 2/2010 | Kuroda | B41J 2/16532 347/23 |
| 2013/0002748 | A1 | 1/2013 | Takano et al. | |
| 2014/0253639 | A1* | 9/2014 | Yokoyama | B41J 2/14233 347/70 |

OTHER PUBLICATIONS

Foreign action dated Mar. 14, 2018, Application No. 10 2017 118 443.0.

* cited by examiner

*Primary Examiner* — Yaovi M Ameh
(74) *Attorney, Agent, or Firm* — Schiff Hardin LLP

(57) ABSTRACT

The negative pressure in the ink chamber of a nozzle of a print head is reduced in a printing interruption phase, in particular upon transport of the print head from a cleaning position into a printing position, relative to the negative pressure in a printing phase. The leaking of ink during the printing interruption phase may thus be reliably avoided, and the print quality may be increased.

16 Claims, 2 Drawing Sheets

METHOD AND CONTROLLER TO PREVENT INK LEAKAGE FROM A PRINT HEAD

CROSS REFERENCE TO RELATED APPLICATIONS

This patent application claims priority to German Patent Application No. 102017118443.0, filed Aug. 14, 2017, which is incorporated herein by reference in its entirety.

BACKGROUND

The disclosure relates to a method and a corresponding controller that are designed to prevent the leaking of ink from a print head of an inkjet printing device.

An inkjet printing device for printing to a recording medium comprises one or more print heads having respectively one more nozzles. The nozzles are respectively set up to eject ink droplets in order to print dots of a print image onto the recording medium. The printing process of an inkjet printing device may be interrupted, in particular in order to clean the one or more print heads. The one or more print heads may be driven out of a printing position into a cleaning position for cleaning of the print heads.

In particular given the movement of the one or more print heads between the cleaning position and the printing position, it may occur that ink leaks from the one or more nozzles of a print head. The leaked ink may dry on a nozzle plate of the print head, and thus lead to a negative effect on the one or more nozzles of the print head. The print quality of the inkjet printing device is thereby in turn negatively affected.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1A:
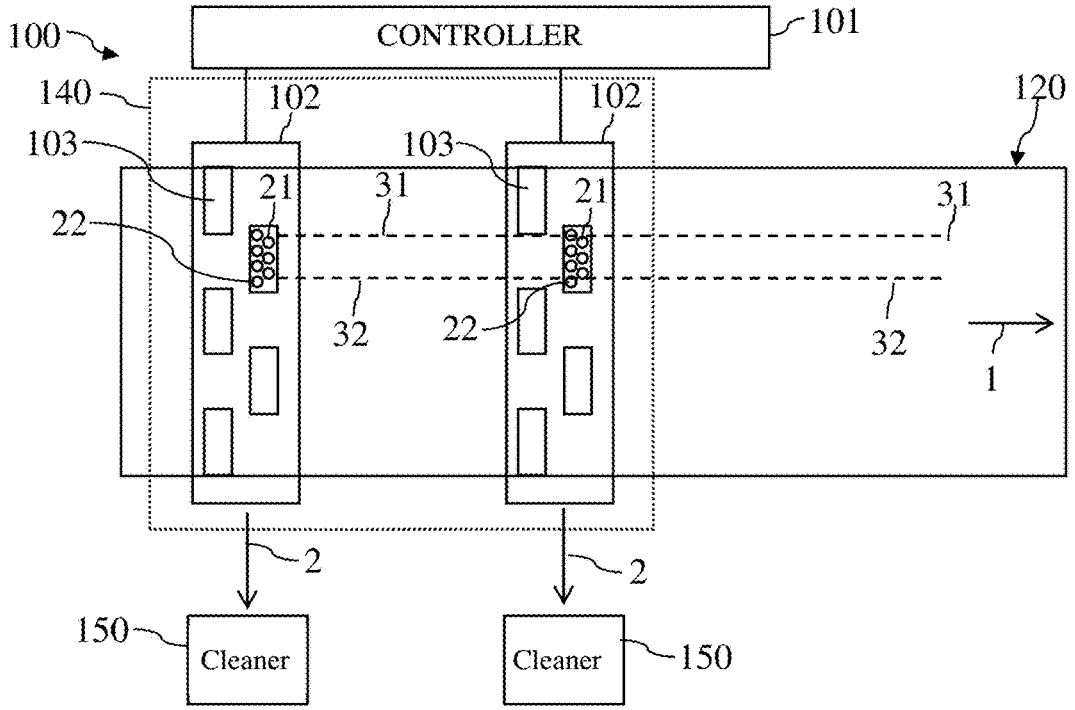
Figure 1B:
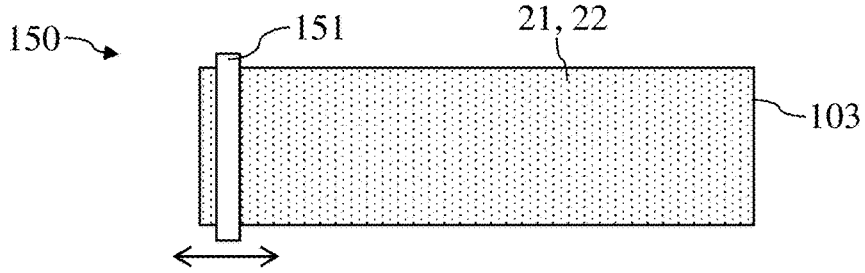
Figure 2:
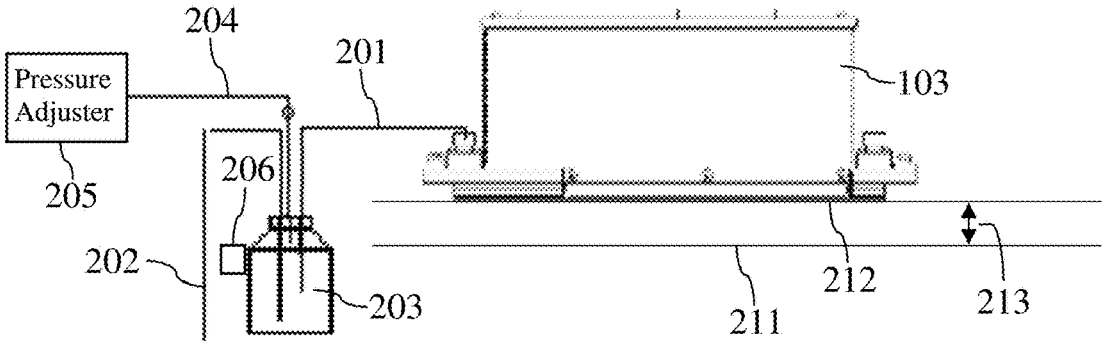
Figure 3A:
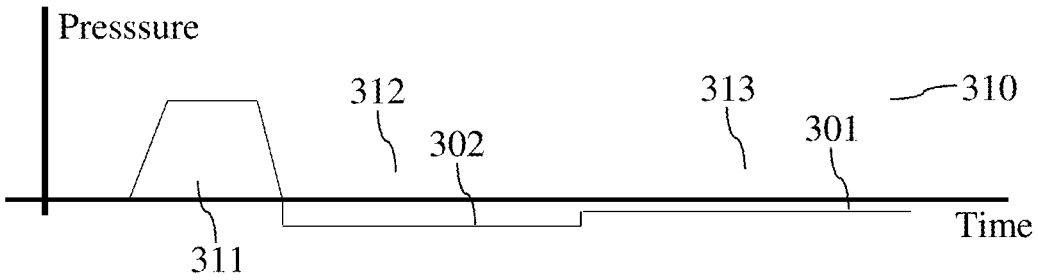
Figure 3B:
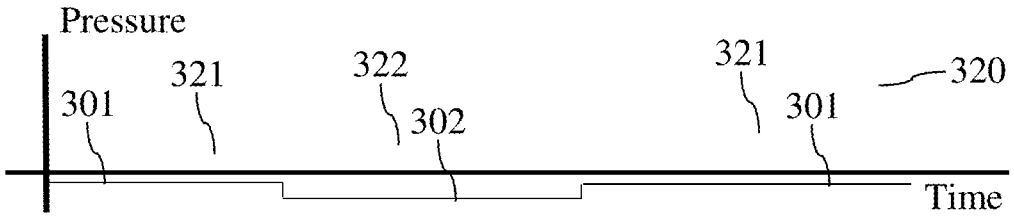
Figure 4:
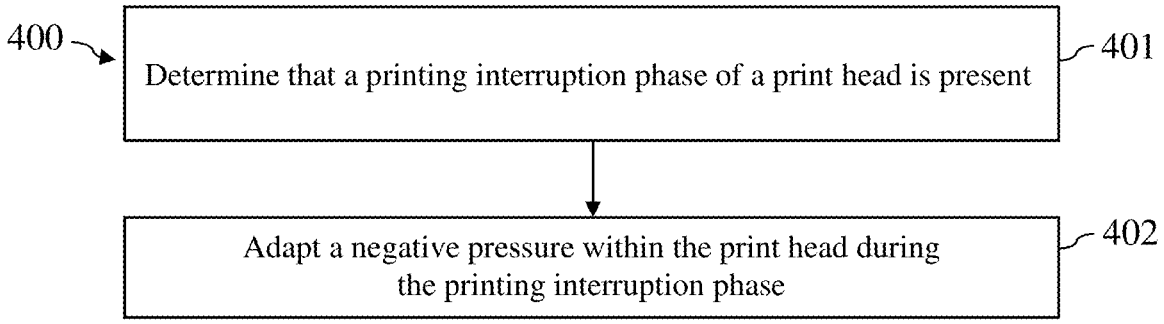

FIG. 1*a* illustrates a block diagram of an inkjet printing device according to an exemplary embodiment of the present disclosure;

FIG. 1*b* illustrates a cleaner of an inkjet printing device according to an exemplary embodiment of the present disclosure;

FIG. 2 illustrates an ink supply for a print head according to an exemplary embodiment of the present disclosure;

FIG. 3*a* illustrates a pressure curve of the physical pressure of ink in a print head given a cleaning process according to an exemplary embodiment of the present disclosure;

FIG. 3*b* illustrates a pressure curve of the physical pressure of ink in a print head given a printing pause according to an exemplary embodiment of the present disclosure; and FIG. 4 illustrates a flowchart of a method for avoiding the leaking of ink from a print head according to an exemplary embodiment of the present disclosure.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure is to prevent the leaking of ink from a print head of an inkjet printing device in a reliable and efficient manner, in order to increase the print quality of the inkjet printing device.

According to one aspect of the disclosure, a method is described for preventing the leaking of ink from a print head of an inkjet printing device, wherein the print head comprises at least one nozzle. The method includes the determination that a printing interruption phase or that a previous print preparation phase was carried out (e.g. printing—head cleaning) of the print head is present/or was present. Moreover, the method includes, in reaction to this, the reduction of a physical rest pressure of the ink in the nozzle to a printing interruption level that is lower than a printing operation level which is used as a rest pressure during a printing phase of the print head.

According to a further aspect of the disclosure, a controller for an inkjet printing device is described that comprises a print head having at least one nozzle. The controller is configured to determine that a printing interruption phase of the print head is present. Moreover, the controller is configured to induce, in reaction to this, a reduction of a physical rest pressure of the ink in the nozzle to a printing interruption level that is lower than a printing operation level which is used as a rest pressure during a printing phase of the print head.

FIG. 1*a* illustrates an inkjet printing device 100 according to an exemplary embodiment. The inkjet printing device 100 can be configured to print to a recording medium 120 in the form of a web (also referred to as a "continuous feed", since the recording medium 120 is supplied to the printing device 100 continuously, for example from a roll), but is not limited thereto. The recording medium 120 may be produced from, for example, paper, paperboard, cardboard, metal, plastic, textiles, a combination thereof, and/or other materials that are suitable and can be printed to. In a continuous feed application, the recording medium 120 is typically taken off a roll (take-off) and then supplied to the print group 140 of the printing system 100. A print image is applied onto the recording medium 120 by the print group 140, and the recording medium 120 that is printed to is taken up again (possibly after fixing/drying of the print image) onto an additional roll (the take-up). Alternatively, the recording medium 120 that is printed to may be cut into sheets or individual pages by a cutting device. In FIG. 1*a*, the transport direction 1 of the recording medium 120 is represented by an arrow. The exemplary embodiments of the present disclosure are also applicable to a printing device 100 for printing to recording media 120 in the form of webs or pages.

In an exemplary embodiment, the print group 140 of the printing device 100 comprises multiple print bars 102 that may respectively be used for printing with ink of different colors (for example black, cyan, magenta, and/or yellow, and possibly Magnetic Ink Character Recognition (MICR) ink and/or orange, violet and green (OVG) ink. A primer is thereby also conceivable.

A print bar 102 may comprise one or more print heads 103 that are, if applicable, arranged next to one another in multiple rows in order to print dots of different columns 31, 32 of a print image onto the recording medium 120. In the example depicted in FIG. 1*a*, a print bar 102 comprises five print heads 103, for example, wherein each print head 103 prints the dots of a group of columns 31, 32 of a print image onto the recording medium 120.

In the embodiment depicted in FIG. 1*a*, each print head 103 of the print group 140 comprises multiple nozzles 21, 22, wherein each nozzle 21, 22 is configured to fire or eject ink droplets onto the recording medium 120. For example, a print head 103 of the print group 140 may comprise 2558, 5116 or more effectively utilized nozzles 21, 22 that are arranged along one or more rows transversal to the transport direction 1 of the recording medium 120. The nozzles 21, 22 in the individual rows may be arranged offset to one another. By means of the nozzles 21, 22 of a print head 103 of the print group 140, dots of a portion of a line of a print image may be printed onto the recording medium 120 transversal to the transport direction 1, meaning along the width of the recording medium 120.

In an exemplary embodiment, the printing device 100 additionally comprises a controller 101 (for example, an activation hardware, control circuit, and/or processor) that is configured to activate actuators of the individual nozzles 21, 22 of the individual print heads 103 of the print group 140 in order to apply the print image onto the recording medium 120 depending on print data. In an exemplary embodiment, the controller 101 includes processor circuitry that is configured to activate the actuators based on the print data.

The print group 140 of the printing device 100 thus comprises at least one print bar 102 having K nozzles 21, 22 that may be activated with a defined line clock signal in order to print a line (transversal to the transport direction 1 of the recording medium 120) with K pixels or K columns 31, 32 of a print image onto the recording medium 120. The nozzles 21, 22 may be distributed among one or more print heads 103. In the presented example, the nozzles 21, 22 are installed stationary or fixed in the printing device 100, and the recording medium 120 is directed past the stationary nozzles 21, 22 with a defined transport velocity in the transport direction 1. Alternatively or additionally, the one or more print heads 103 may be moved across the recording medium 120 (for example transversal to the transport direction 1 of the recording medium 120).

In the example depicted in FIG. 1*a*, a specific nozzle 21, 22 prints a corresponding specific column 31, 32 (in the transport direction 1) of a print image onto the recording medium 120. In other words, a one-to-one association between nozzles 21, 22 and columns 31, 32 may exist so that the dots of a first column 31 of the print image may be printed exclusively by a first nozzle 21, and the dots of a second column 32 of the print image may be printed exclusively by a different, second nozzle 22. Each nozzle 21, 22 of a print head 103 of the print group 140 may thus be associated with precisely one column 31, 32, and each column 31, 32 may be associated with precisely one nozzle 21, 22 of a print head 103. A maximum of one ink ejection (wherein multiple partial droplets are possibly ejected in one ink ejection that combine into one dot or pixel, at the latest on the recording medium 120) thus takes place via a specific nozzle 21, 22 per line of a print image. With this it is sought to generate a dot on the recording medium.

In an exemplary embodiment, the printing device 100 comprises one or more cleaners 150. A print bar 102 may be transferred from a printing position at which the print bar 102 is arranged above the recording medium 120 into a cleaning position within a cleaner 150. For this purpose, the print bar 102 may be moved in the movement direction 2 indicated by an arrow. The printing device 100 may have a cleaner 150 for each print bar 102 or print head 103.

FIG. 1*b* shows the underside or the nozzle plate of a print head 103 of a print bar 102 within a cleaner 150. Arranged on the underside or the nozzle plate of the print head 103 are the outputs of the one or more nozzles 21, 22 of the print head 103. In the cleaner 150, the nozzle plate of a print head 103 may initially be sprayed with a cleaning agent. Furthermore, the one or more nozzles 21, 22 of the print head 103 may be induced to eject ink, for example by increasing the (rest) pressure within the one or more nozzles 21, 22. This step may be referred to as "purging." The underside of the print head 103 may subsequently be cleaned with a wiper 151. The wiper 151 may be moved across the nozzle plate in the direction indicated by the double arrow in order to clean said nozzle plate. This step may be referred to as "wiping".

Movement of a print bar 102 or print head 103 between the cleaning position and the printing position may lead to ink leaking from the one or more nozzles 21, 22 of a print head 103. This may be disadvantageous, in particular, on the way from the cleaning position to the printing position, since the nozzle plate of the print head 103 is soiled again due to the leaking of the ink. The leaked ink may dry and thus lead to a negative effect on a nozzle 21, 22. For example, it may lead to nozzle failures and/or to deviations of the flight path of ink droplets. The print quality of an inkjet printing device 100 may thus be negatively affected as a result.

Upon movement of a print bar 102 or of the print head from the cleaning position into the printing position, ink may thus (e.g. depending on the ink temperature, the surface tension of the ink, the surface energy of the print head surface 212, etc.) leak from a nozzle 21, 22 and dry out. Upon the start of printing, due to the leaked and dried ink, the nozzle 21, 22 may possibly not clearly fire (i.e. "fire clear"). In particular, it may also possibly occur that not all nozzles 21, 22 of a print head 103 or of a print bar 102 are completely regenerated by refresh measures, meaning by the printing of refresh print images before the actual printing of print data-dependent print images. Nozzle failures and print image disruptions may thus occur.

FIG. 2 shows the ink supply of an example of a print head 103. The individual nozzles 21, 22 of a print head 103 may be supplied via an ink channel 201. The ink channel 201 may thereby refer to the ink from a negative pressure tank 203 or ink storage tank. The negative pressure tank 203 may in turn be supplied with ink from an ink reservoir via a supply channel 202. The negative pressure tank 203 may be used to set a specific physical negative pressure within the individual nozzles 21, 22 of the print head 103. Via this negative pressure, it may be ensured that an ink meniscus forms at the output of a nozzle 21, 22. In operation, the ink meniscus may be set into motion by an actuator of the nozzle 21, 22 (for example by a piezoelectric actuator) in order to eject an ink droplet from the nozzle 21, 22. In an exemplary embodiment, the physical (negative) pressure in the nozzles 21, 22 of a print head may be set to a printing operation level in a printing phase. The printing operation level may thereby be set mechanically via the height difference 213 between the nozzle plate 212 of the print head 103 and the fill level 211 of the negative pressure tank 203. A typically fixed (negative) pressure at the printing operation level results from the typically fixed height difference 213.

The use of a physical pressure at the printing operation level is typically optimized for the generation of ink droplets in printing operation. On the other hand, it has been shown that a physical pressure at the printing operation level cannot reliably prevent a leaking of ink in a printing interruption phase of a print head 103. In particular, it may lead to a leaking of ink if the physical pressure is also maintained at the printing operation level during the transport of a print head 103 between the printing position and the cleaning position. For example, vibrations of the print head 103 during the transport may lead to a leaking of ink. Furthermore, a leaking of ink may also occur in printing pauses in which, although a print head 103 remains at the printing position, no ejection of ink droplets takes place. The extent to which ink leaks from a print head 103 may thereby depend on the operating age of the print head 103. It has been shown that the extent of leaked ink also typically increases with increasing operating age, and/or with a degradation of the state of the nozzle plate 212 of a print head 103.

In an exemplary embodiment, the printing device 100 includes a pressure adjuster 205 that is configured to vary the physical pressure in a nozzle 21, 22 of a print head 103. In particular, a physical rest pressure in a rest state of the nozzle 21, 22 may be adapted by the pressure adjuster 205. The physical rest pressure is thereby typically negative, meaning that the physical rest pressure is typically a negative pressure. The actuator of the nozzle 21, 22 may then vary the physical pressure within the nozzle 21, 22, starting from this physical rest pressure, in order to set the ink meniscus of the nozzle 21, 22 into motion. In an exemplary embodiment, the pressure adjuster 205 includes processor circuitry that is configured to adjust the pressure in the nozzle(s) 21, 22 of the print head 103.

In an exemplary embodiment, the pressure adjuster 205 is configured to vary the fill level 211 in the negative pressure tank 203 via an ink channel 204 to vary the level of the physical pressure within the one or more nozzles 21, 22 of a print head 103. For example, air may be pumped into the negative pressure tank 203 or be drawn from the negative pressure tank by means of a compressed air source, in order to adapt the rest pressure within the one or more nozzles 21, 22. At the negative pressure tank 203, a sensor 206 may be arranged that indicates sensor data with regard to the rest pressure. The sensor 206 may, for example, comprise a pressure sensor and/or a preferably analog fill level height sensor. The controller 101 of the printing device 100 may be configured to control or regulate the pressure adjuster 205 depending on the sensor data of the sensor 206. The rest pressure within the one or more nozzles 21, 22 of a print head 103 may thus be regulated to a specific level.

In an exemplary embodiment, the pressure adjuster 205 is configured to adapt the rest pressure depending on the operating state of a print head 103. For example, the rest pressure may be set to the printing operation level in a printing operation, or during a printing phase of the print head 103. In an exemplary embodiment, the printing operation level is adapted depending on the operating age of the print head 103 and/or depending on the state of the nozzle plate 212 of the print head 103. In particular, the printing operation level may be decreased with increasing operating age, meaning that the absolute value of the negative pressure of the ink in a nozzle 21, 22 may be improved with increasing operating age, or with degradation and/or variation of the state of the nozzle plate 212.

On the other hand, in an exemplary embodiment, given a printing operation or in a printing pause of the print head 103, the physical rest pressure may be decreased to a printing interruption level, meaning that the negative pressure may be further increased in magnitude relative to the printing operation level. In an exemplary embodiment, the printing interruption level thereby depends on the operating age of the print head 103 and/or on the state of the nozzle plate 212, and typically decrease—i.e. increase in magnitude—with increasing operating age, or with degradation of the state of the nozzle plate 212. Furthermore, the printing interruption level of the physical rest pressure may be adjusted such that, although the ink meniscus of the one or more nozzles 21, 22 are drawn further into the respective nozzle chambers, the ink meniscus does not tear off and thereby does not cause an air inclusion within the respective nozzle chambers. In an exemplary embodiment, the printing interruption level is determined experimentally for a specific type of print head 103.

FIG. 3*a* shows a chronological pressure curve 310, according to an exemplary embodiment, of the physical rest pressure in a printing interruption during which a print head 103 is cleaned. To "purge" the one or more nozzles 21, 22 of the print head 103, the physical pressure within the nozzles 21, 22 is increased to a positive value in a purge phase 311 so that ink is driven out of the nozzles 21, 22. In a transport phase 312, the physical pressure is reduce to a negative printing interruption level 302 for the transport of the print head 103 from the cleaning position to the printing position. In a printing phase 313, the physical negative pressure is then increased thereby decreasing the absolute value of pressure to the respective negative printing operation level 301 so that the print head 103 may be used for the printing of a print image on a recording medium 120.

FIG. 3*b* shows a chronological pressure curve 320, according to an exemplary embodiment, of the physical rest pressure in a printing interruption during which, although the print head 103 remains at the printing position, no print image is printed onto a recording medium 120. During the printing phases 321 of the printing operation, the physical rest pressure in the nozzles 21, 22 is set to the printing operation level 301. On the other hand, the printing interruption level 302 of the physical rest pressure is set during a printing pause 322.

The transition from the purge phase 311 to the transport phase 312 and the transition from the transport phase 312 to the printing phase 313 have been depicted as a step functions in FIG. 3*a*. These transitions can also have a certain finite slope to it. The transition from the printing phase 321 to the printing pause 322 and the transition from the printing pause 322 to the printing phase 321 have been depicted as a step function in FIG. 3*b*. These transitions can also have a certain finite slope to it.

If applicable, in an exemplary embodiment, a regulated negative pressure may thus be set in the negative pressure tank 203 after a purge/wipe process, possibly independently of the age of the print head 103 (e.g., depending on the wear due to cleaning and/or the wear due to the printing operation). The leaking of ink during the travel time from the cleaning position into the printing position may thus be prevented.

In an exemplary embodiment, the pressure adjuster 205 is configured to adjust the negative pressure, for example, via a valve. This process may take a certain amount of time. Alternatively or additionally, the negative pressure may be regulated depending on the measured pressure in the negative pressure tank 203. In an exemplary embodiment, a regulated negative pressure is adjusted and/or regulated as needed, for example depending on the wear of the nozzle plate, the viscosity of the ink, and/or the temperature of the ink. The regulated negative pressure in the negative pressure tank 203 may then prevent the leaking of the ink from a nozzle 21, 22 given a printing interruption. In particular, it may have the effect that ink only leaks—if at all—shortly before the beginning of the printing operation, and thus cannot dry and therefore clog the nozzle 21, 22.

As a result of this, a reliable regeneration of the nozzles 21, 22 of a print head 103 may be produced via refresh measures after the end of a printing interruption. Nozzle failures may thus be avoided, and the print quality of a printing device 100 may be increased.

During the print head service life, a surface coating on the nozzle plate 212 may be damaged, for example by mechanical friction of the wiper 151 upon cleaning and/or by manual cleaning of the nozzle plate 212 or by inadvertent contact with recording medium. The valve effect of a nozzle 21, 22 may therefore decrease in the course of the print head service life. In an exemplary embodiment, to maintain the valve function of the nozzles 21, 22, the negative pressure at the negative pressure tank 203 is increased in magnitude corresponding to the print head service life, or corresponding to the state of the nozzle plate 212. The adjustment of the negative pressure may take place individually for each print head 103 or jointly for the print heads 103 of a print bar 102.

Via the adaptation of the negative pressure in a print head 103, a high print quality may be enabled, in particular at the start of printing and possibly also during the printing operation with an old print head 103. Via the adaptation of the negative pressure, a leaking of ink during a printing interruption may be avoided. At the same time, via a precise adjustment of the negative pressure and/or of the fill level of the nozzles 21, 22 it may be achieved that no air may enter into the nozzle channel of a print head 103. Moreover, a necessary amount of refresh measures, in particular the number of refresh print images that are to be printed, may be reduced via the measures described in this document.

FIG. 4 shows a workflow diagram of a method 400 according to an exemplary embodiment for preventing the leaking of ink from a print head 103 of an inkjet printing device 100. The inkjet printing device 100 may be designed as described in according to the exemplary embodiments of the present disclosure, for example, as described in connection with FIG. 1*a*. The print head 103 of the printing device 100 comprises at least one nozzle 21, 22. The print head 103 typically comprises a plurality of nozzles 21, 22, but is not limited thereto.

In an exemplary embodiment, the method 400 includes the determination 401 that a printing interruption phase 312, 322 of the print head 103 is present. In a printing interruption phase 312, 322, typically no activation of the actuators of the one or more nozzles 21, 22 of a print head 103 takes place.

In an exemplary embodiment, the print head 103 is configured to be moved from a printing position into a cleaning position for a cleaning of the print head 103. For example, the printing position may be arranged directly above a recording medium 120. On the other hand, the cleaning position may be arranged laterally offset, in a cleaner 150 of the printing device 100. For example, the print head 103—in particular as part of a print bar 102 having multiple print heads 103, as depicted in FIG. 1*a*—may be moved along the movement direction 2 to the cleaning position. A cleaning of the nozzle plate 212 of the print head 103 may then take place at the cleaning position. The printing interruption phase 312, 322 may correspond to a transport phase 312 during which the print head 103 is moved from the cleaning position back to the printing position, in particular following a cleaning.

In an exemplary embodiment, alternatively or additionally, the printing interruption phase correspond to a printing pause 322 between two printing phases 321. In a printing phase 321, an activation of the actuators of the one or more nozzles 21, 22 of a print head 103 thus takes place. On the other hand, typically no activation and/or deflection of the actuators of the one or more nozzles 21, 22 of the print head 103 takes place during a printing pause 322. The print head 103 nevertheless typically remains at the printing position, in particular above the recording medium 120, in a printing pause 322.

In an exemplary embodiment, in reaction to the determination 401 that the print head 103 is located in a printing interruption phase 312, 322, the method 400 also includes the reduction 402 of a physical rest pressure of the ink in the nozzle 21, 22 to a printing interruption level 302. The physical rest pressure is thereby typically negative, meaning a negative pressure. The printing interruption level 302 is lower than the printing operation level 301 which is used during a printing phase 313, 321 of the print head 103 as a typically negative physical rest pressure. In other words, in a printing interruption phase 321, 322, the physical rest pressure of the ink in the nozzle 21, 22 of the print head 103 may be reduced in phase 322, in particular in comparison to the physical rest pressure that is used for the printing operation of the nozzle 21, 22.

A method 400 is thus described in which, in a printing interruption phase 312, 322, in particular upon transport of the print head 103 from a cleaning position to a printing position, the negative pressure in the ink chamber of a nozzle 21, 22 of a print head 103 is reduced relative to the negative pressure in a printing phase 313, 321 of the print head 103. The leaking of ink during the printing interruption phase 312, 322 may thus be reliably avoided, and in particular the initial print quality of an inkjet printing device 100 may be increased.

In an exemplary embodiment, the physical rest pressure corresponds to a physical pressure in an ink chamber of the nozzle 21, 22 that is present if the actuator of the nozzle 21, 22 is located in a rest state and/or is not activated and/or is not supplied with current. The physical rest pressure may, for example, correspond to the pressure in the ink chamber of the nozzle 21, 22 that is present if the actuator of the nozzle 21, 22 does not exhibit any deflection from a rest position. The set physical rest pressure may thereby correspond to the possible pump capacity of, for example, the piezoelectric actuators.

In an exemplary embodiment, the printing interruption level 302 is such that substantially no air is drawn via the nozzle 21, 22 into the ink chamber and/or into an ink channel 201 of the nozzle 21, 22. In an exemplary embodiment, the printing interruption level 302 may be experimentally determined for this purpose. A leaking of ink may typically be reliably avoided if the physical rest pressure in the ink chamber is low, i.e. if a high (in terms of magnitude) negative pressure is present in the ink chamber. In an exemplary embodiment, the printing interruption level 302 is therefore as close as possible to a limit level as of which air is drawn via the nozzle 21, 22 into the ink chamber and/or into the ink channel 201 of the nozzle 21, 22.

The physical rest pressure of the ink in the nozzle 21, 22 may be regulated at the printing interruption level 302. The leaking of ink may thus be especially reliably avoided.

In an exemplary embodiment, the method 400 includes the determination of state information with regard to a state of the nozzle plate 212 of the print head 103. In particular, the state information may indicate the state of a protective layer on the nozzle plate 212. For example, the state information may include or indicate: a number of operating hours of the print head 103; an age of the print head 103; and/or a number of cleaning processes (e.g. wiping processes) that have been performed on the nozzle plate 212 of the print head 103. In an exemplary embodiment, an optical refresh print image evaluation is likewise possible immediately after the start of printing. In an exemplary embodiment, this take place using a camera, such as a charge coupled device (CCD) camera or the like. The set pressure 302 may thereby be monitored and corrected as necessary. In an exemplary embodiment, the printing interruption level 302, and possibly the print operating level 301, is then adapted depending on the state information. In particular, the printing interruption level 302, and possibly the print operating level 301, may be reduced—meaning that the respective physical negative pressure may be increased in terms of magnitude—if the state information indicates that the state of the nozzle plate 212 has degraded or been altered, or that the nozzle plate 212 has aged. A high initial print quality may thus be achieved even given an advanced age of a print head 103.

In an exemplary embodiment, the method 400 is executed separately for each print head 103 of a print bar 102. In particular, the rest pressure for each print head 103 may be adapted individually and/or independently of the other print heads 103 of a print bar 102. The leaking of ink may thus be prevented in a particularly reliable manner. On the other hand, the rest pressure for multiple print heads 103 of a print bar 102, in particular for all print heads 103 of a print bar 102, may be adapted jointly in a way that is especially efficient in terms of cost and installation space. A common negative pressure tank 203 and/or a common pressure adjuster 205 may then be provided for multiple print heads 103. In a printing device 100 with multiple print bars 102 for different inks, the method 400 may respectively be executed for the individual print bars 102.

Furthermore, a controller 101 for an inkjet printing device 100 is described in this document. The printing device 100 thereby comprises a print head 103 having at least one nozzle 21, 22. In an exemplary embodiment, the controller 101 is configured to determine that a printing interruption phase 312, 322 of the print head 103 is present. Typically, no activation of the actuators of the one or more nozzles 21, 22 of the print head 103 thereby takes place in a printing interruption phase 312, 322.

The controller 101 is also configured to induce the physical rest pressure of the ink in the nozzle 21, 22 to be reduced to a printing interruption level 302 that is lower than a printing operation level 301 which is used as a physical rest pressure during a printing phase 313, 321 of the print head 103, possibly only when it has been determined that a printing interruption phase 312, 322 of the print head 103 is present. In an exemplary embodiment, the controller 101 includes processor circuitry that is configured to determine phases of the print head 103, and/or induce or otherwise control an adjustment of pressure of the tank 203. For example, the controller 101 can control the pressure adjuster 205 to adjust the pressure.

In an exemplary embodiment, the inkjet printing device 100 includes a negative pressure tank 203 with ink, wherein the negative pressure tank 203 is connected with the print head 103 via an ink channel 201. Ink for the printing operation of the print head 103 may thus be provided via the ink channel 201. The negative pressure tank 203 may be arranged with a defined height difference 213 below the nozzle plate 212 of the print head 103. In particular, a height difference 213 may exist between the fill level 211 of the ink in the negative pressure tank 203 and the nozzle plate 212. The physical rest pressure in the nozzle 21, 22 of the print head 103 may be adjusted to the printing operation level 301 via the (possibly hard-set) height difference 213. In particular, the physical rest pressure of the ink in the nozzle 21, 22 may be set at the printing operation level 301 solely by the height difference 213.

Moreover, in an exemplary embodiment, the inkjet printing device 100 includes a pressure adjuster 205 that is configured to vary a physical pressure and/or an ink fill level 211 in the negative pressure tank 203. The physical rest pressure of the ink in the nozzle 21, 22 of the print head 103 may thus be indirectly varied. In an exemplary embodiment, the pressure adjuster 205 includes, for example, a valve and/or a pump and/or a compressed air source (in particular a Venturi nozzle). In an exemplary embodiment, alternatively or additionally, the pressure adjuster 205 is configured to vary the height difference 213 between the negative pressure tank 203 and the nozzle plate 212 in order to vary the physical rest pressure of the ink in the nozzle 21, 22. In an exemplary embodiment, the controller 101 is configured to induce the pressure adjuster 205 to reduce the physical rest pressure of the ink in the nozzle 21, 22 to the printing interruption level 302.

In an exemplary embodiment, the inkjet printing device 100 includes a sensor 206 that is configured to acquire sensor data with regard to the physical rest pressure of the ink in the nozzle 21, 22. For example, a pressure sensor and/or a fill level sensor may be arranged at the pressure adjuster 205 in order to acquire the sensor data with regard to the physical rest pressure of the ink in the nozzle 21, 22. In an exemplary embodiment, the controller 101 is configured to reduce (or otherwise adjust), in particular to regulate, the physical rest pressure of the ink in the nozzle 21, 22 to the printing interruption level 302 depending on the sensor data.

In an exemplary embodiment, the inkjet printing device 100 includes the controller 101 described herein.

In an exemplary embodiment, the printing device 100 includes a print head 103 having at least one nozzle 21, 22, wherein the nozzle 21, 22 is configured to eject ink droplets onto a recording medium 120 in a printing phase 313, 321 in order to print a print image onto the recording medium 120. Moreover, in an exemplary embodiment, the printing device 100 includes a negative pressure tank 203, wherein the negative pressure tank 203 is connected with the print head 103 via an ink channel 201 in order to provide ink for the printing of a print image.

Furthermore, in an exemplary embodiment, the printing device includes a pressure adjuster 205 that is configured to vary a physical negative or positive pressure in the tank 203 in order to vary a physical rest pressure of the ink in the nozzle 21, 22. In an exemplary embodiment, the controller 101 of the printing device 100 is configured to induce the pressure adjuster 205 to vary the physical rest pressure of the ink in the nozzle 21, 22.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, other structural electronic hardware, or a combination thereof. A processor includes a microprocessor, a digital signal processor (DSP), central processing unit (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction (of the recording medium)
2 movement direction (of a print bar)
21, 22 nozzle
31, 32 column (of the print image)
100 printing device
101 controller
102 print bar
103 print head
120 recording medium
150 cleaner
151 wiper
201 ink channel
202 supply channel
203 negative pressure tank
204 ink channel
205 pressure adjuster
206 sensor
211 fill level
212 nozzle plate
213 height difference
301 printing operation level
302 printing interruption level
310 pressure curve of the physical rest pressure
311 purge phase
312 transport phase
313 printing phase
320 pressure curve of the physical rest pressure
321 printing phase
322 printing pause
400 method for preventing the leaking of ink
401-402 method steps

The invention claimed is:

1. A method for preventing the leaking of ink from a print head of an inkjet printing device, the print head including a nozzle plate and at least one nozzle, the method comprising:

determining presence of a printing interruption phase of the print head or that a previous print preparation phase has been performed;

reducing, based on the determination, a physical rest pressure of the ink in the nozzle to a printing interruption level that is lower than a printing operation level used as a rest pressure during a printing phase of the print head;

determining state information corresponding to a degree of degradation of a protective layer disposed on the nozzle plate of the print head; and adapting the printing interruption level based on the state information.

2. The method according to claim 1, wherein the rest pressure corresponds to a physical pressure in an ink chamber of the nozzle that is present when an actuator of the nozzle is located in a rest state or is not activated.

3. The method according to claim 1, wherein the printing interruption level is such that substantially no air is drawn via the nozzle into an ink chamber and/or an ink channel of said nozzle.

4. The method according to claim 1, wherein:

the print head is moved from a printing position into a cleaning position for a cleaning; and the printing interruption phase corresponds to a transport phase during which the print head is moved from the cleaning position back to the printing position.

5. The method according to claim 1, wherein the printing interruption phase corresponds to a printing pause between two printing phases in which the print head remains at a printing position above a recording medium.

6. A non-transitory computer-readable storage medium with an executable program stored thereon, when executed, causes a processor to perform the method of claim 1.

7. A controller comprising:

a memory storing instructions; and a processor coupled to the memory and configured to execute the instructions to perform the method of claim 1.

8. The method according to claim 1, wherein the state information comprises a number of operating hours of the print head and/or an age of the print head.

9. The method according to claim 1, wherein the state information comprises a number of cleaning processes that have been performed on the nozzle plate.

10. The method according to claim 1, wherein adapting the printing interruption level based on the state information increases a magnitude of a negative pressure within an ink chamber to reduce the physical rest pressure of the ink in the nozzle to the printing interruption level.

11. A pressure controlling apparatus for an inkjet printing device, comprising:

an output; and a controller that is configured to:

determine a presence of a printing interruption phase of a print head of the inkjet printing device or that a previous print preparation phase has been performed;

generate a control signal, based on the determination, to induce a reduction of a physical rest pressure of ink in a nozzle of the print head to a printing interruption level that is lower than a printing operation level which is used as a rest pressure during a printing phase of the print head;

determine state information corresponding to a degree of degradation of a protective layer disposed on a nozzle plate of the print head;

adapt the printing interruption level based on the determined state information; and provide the generated control signal to the output.

12. The pressure controlling apparatus according to claim 11, wherein:

the inkjet printing device further comprises:

a negative pressure tank with ink that is connected via an ink channel with the print head; and a pressure adjuster that is configured to vary a pressure in the negative pressure tank; and the controller is configured to provide the control signal to the pressure adjuster via the output to induce the pressure adjuster to reduce the physical rest pressure of the ink in the nozzle to the printing interruption level.

13. The pressure controlling apparatus according to claim 12, wherein:

the inkjet printing device further comprises a sensor that is configured to acquire sensor data with regard to the physical rest pressure of the ink in the nozzle; and the controller is configured to generate the control signal based on the sensor data to regulate the physical rest pressure of the ink in the nozzle to the printing interruption phase.

14. The pressure controlling apparatus according to claim 11, wherein:

the inkjet printing device further comprises a sensor that is configured to acquire sensor data with regard to the physical rest pressure of the ink in the nozzle; and the controller is configured to generate the control signal based on the sensor data to regulate the physical rest pressure of the ink in the nozzle to the printing interruption phase.

15. An inkjet printing device, comprising:

a print head having at least one nozzle that is configured to eject ink droplets onto a recording medium in a printing phase to print a print image onto the recording medium;

a negative pressure tank that stores ink and that is connected with the print head via an ink channel to provide ink for printing of a print image;

a pressure adjuster configured to vary a physical pressure in the negative pressure tank to vary a physical rest pressure of ink in the nozzle; and a controller that is configured to:

determine a presence of a printing interruption phase of a print head of the inkjet printing device or that a previous print preparation phase has been performed;

determine state information corresponding to a degree of degradation of a protective layer disposed on a nozzle plate of the print head;

adapt the printing interruption level based on the state information; and induce the pressure adjuster, based on the determination of the presence of the printing interruption phase or that the previous print preparation phase has been performed, to vary the physical rest pressure of the ink in the nozzle.

16. The inkjet printing device according to claim 15, wherein the controller is configured to induce the pressure adjuster to reduce the physical rest pressure of the ink in the nozzle to a printing interruption level that is lower than a printing operation level which is used as a rest pressure during a printing phase of the print head.

* * * * *